US008529053B2

(12) United States Patent
Makimoto

(10) Patent No.: US 8,529,053 B2
(45) Date of Patent: Sep. 10, 2013

(54) SEASONING DEVICE AND IMAGE FORMING APPARATUS

(75) Inventor: Akihiro Makimoto, Kanagawa (JP)

(73) Assignee: FujiFilm Corporation, Tokyo (JP)

( * ) Notice: Subject to any disclaimer, the term of this patent is extended or adjusted under 35 U.S.C. 154(b) by 99 days.

(21) Appl. No.: 13/190,493

(22) Filed: Jul. 26, 2011

(65) Prior Publication Data

US 2012/0038722 A1 Feb. 16, 2012

(30) Foreign Application Priority Data

Aug. 10, 2010 (JP) ..... 2010-179536

(51) Int. Cl.
*B41J 2/01* (2006.01)

(52) U.S. Cl.
USPC ..... 347/102; 347/101

(58) Field of Classification Search
USPC ..... 347/101, 102; 399/390, 406
See application file for complete search history.

(56) References Cited

U.S. PATENT DOCUMENTS 5,842,105 A * 11/1998 Acquaviva ..... 399/406
6,259,887 B1 * 7/2001 Awano ..... 399/390
6,340,225 B1 * 1/2002 Szlucha ..... 347/102
2004/0109054 A1 * 6/2004 Martin et al. ..... 347/102
2009/0256896 A1 * 10/2009 Scarlata ..... 347/101

FOREIGN PATENT DOCUMENTS

JP 2007-177081 A 7/2007

* cited by examiner

*Primary Examiner* — Manish S Shah
*Assistant Examiner* — Yaovi Ameh
(74) *Attorney, Agent, or Firm* — Solaris Intellectual Property Group, PLLC

(57) ABSTRACT

Sheets of paper discharged from an apparatus main body are stacked in a stack unit and humidified air is blown to the stacked sheets of paper by a spray device (humidifying seasoning). The humidified air blown by the spray device is blown between the sheets of paper to supply moisture to a non-image-formed portion. After blowing the humidified air for 5 minutes, nozzles of a water pipe is closed under the control of a controller and non-humidified air of the atmosphere is blown to the sheets of paper for 10 minutes (blowing seasoning). Accordingly, since the amount of moisture in the non-image-formed portion is returned to the amount of moisture originally contained in the sheets of paper, the difference in the amounts of moisture between an image-formed portion and a non-image-formed portion is reduced, thereby suppressing the cockling generated in the sheets of paper.

16 Claims, 3 Drawing Sheets

SEASONING DEVICE AND IMAGE FORMING APPARATUS

CROSS-REFERENCE TO RELATED APPLICATION

This application is based on and claims priority under 35 USC 119 from Japanese Patent Application No. 2010-179536 filed on Aug. 10, 2010, the disclosure of which is incorporated by reference herein.

BACKGROUND OF THE INVENTION

1. Field of the Invention

The present invention relates to a seasoning device and an image forming apparatus.

2. Related Art

Japanese Patent Application Laid-Open No. 2007-177081 discloses a technique of, by generating micro cracks as fine cracks to a certain extent in image and line portions of a printed medium which is generated by heat-set printing as a kind of offset printing, alleviating the stress inside a dried ink film and reducing wrinkles fixedly formed by the dried film.

However, in the related art, the material components of a liquid (ink) used to form an image are limited.

SUMMARY OF THE INVENTION

The invention is provided to suppress the cockling (ripples) generated in a recording medium (a sheet of paper) having an image formed thereon without depending on the material of a liquid used to form an image.

According to a first aspect of the invention, there is provided a seasoning device including: a stack unit on which a recording medium is stacked, the recording medium having an image formed thereon by ejection of liquid droplets and the image being dried; and a spray unit that blows humidified air at the recording medium stacked in the stack unit.

According to this configuration, the recording mediums which liquid droplets are ejected to form an image and the formed image is dried are stacked in the stack unit. The spray unit blows the humidified air toward the recording mediums stacked on the stack unit (the humidified air is blown from an end portion of the stacked recording mediums between the recording mediums). Accordingly, an amount of moisture (moisture content) in a non-image-formed portion (a portion in which an image is not formed) of the recording medium increases.

In this way, by raising the amount of moisture in the non-image-formed portion of the recording medium, the difference in the amounts of moisture between an image-formed portion (a portion in which an image is formed) and the non-image-formed portion is reduced. Accordingly, it is possible to suppress the cockling (ripples) generated in the recording medium.

In this way, in the aspect, the seasoning device is a device that adjusts moisture (humidity) of the recording medium (moisture content in the recording medium) by blowing humidified air at the recording medium stacked in the stack unit.

A second aspect of the invention provides the seasoning device according to the first aspect, wherein the spray unit blows non-humidified air in the atmosphere at the recording medium after blowing humidified air at the recording medium.

According to this configuration, the spray unit blows non-humidified air in the atmosphere to the recording medium after blowing the humidified air to the recording medium. Accordingly, it is possible to quickly adapt the recording medium to the temperature and humidity of the surrounding atmosphere.

A third aspect of the invention provides the seasoning device according to the first or second aspect, wherein the spray unit blows humidified air having a humidity which does not raise a residual amount of moisture contained in an image-formed portion of the recording medium to which the liquid droplets have been ejected to form the image.

According to this configuration, the spray unit blows the air with a humidity which does not raise the amount of moisture contained in the image-formed portion to which the liquid droplets are ejected to form the image. Accordingly, it is possible to effectively reduce the difference in the amounts of moisture between the image-formed portion and the non-image-formed portion.

A fourth aspect of the invention provides the seasoning device according to any one of the first to third aspects, wherein: the recording medium, on which the image is formed, is discharged from an apparatus main body of an image forming apparatus that forms the image, and the discharged recording medium is stacked in the stack unit, and the spray unit extends in a direction intersecting a discharge direction of the recording medium.

According to this configuration, the spray unit extends in the direction intersecting the discharging direction of the recording medium. Accordingly, it is possible to blow the humidified air over the width direction of the recording medium.

A fifth aspect of the invention provides the seasoning device according to any one of the first to fourth aspects, wherein the spray unit includes: a water pipe having nozzles from which a mist is sprayed, a water supply device that supplies water to the water pipe, and an air blower that blows humidified air that is humidified by the mist sprayed from the nozzles of the water pipe.

According to this configuration, the water supply device supplies water to the water pipe and the mist is sprayed from the nozzles of the water pipe. The air blower blows the air, which is humidified with the mist sprayed from the nozzles of the water pipe, to the recording medium.

Accordingly, it is possible to blow the humidified air to the recording medium with a simple structure.

A sixth aspect of the invention provides the seasoning device according to the fifth aspect, the device further includes: a humidity detecting section that detects the humidity of a region at which the recording medium is discharged from the apparatus main body; and a controller that controls a volume of water supplied to the water pipe by the water supply device on the basis of a detection signal from the humidity detecting section.

According to this configuration, the humidity detecting section detects the humidity of the portion in which the recording medium is discharged from the apparatus main body. The controller controls the volume of water supplied to the water pipe by the water supply device on the basis of the detection signal from the humidity detecting section.

Accordingly, it is possible to blow the air humidified in the optimal humidity to the recording medium with a simple structure.

A seventh aspect of the invention provides the seasoning device according to the sixth aspect, wherein the controller controls a driving power of the air blower according to a discharge speed of the recording medium.

According to this configuration, since the controller controls the driving power of the air blower according to the discharge speed of the recording medium, it is possible to set the amount of air blown to the recording medium to the optimal amount according to the discharging speed of the recording medium.

An eighth aspect of the invention provides the seasoning device according to the sixth or seventh aspect, wherein the controller selectively controls opening and closing of the nozzles of the water pipe according to a size of the recording medium.

According to this configuration, the controller selectively controls the opening and closing of the nozzles of the water pipe according to the size of the recording medium. Accordingly, it is possible to blow the humidified air to only the recording medium and thus to suppress the humidified air from flying around the recording medium.

A ninth aspect of the invention provides the seasoning device according to any one of the first to eighth aspects, wherein the stack unit is vertically movable.

According to this configuration, the stack unit is disposed so as to be able to move up and down. By causing the stack unit to move up and down, it is possible to uniformly blow the humidified air between the stacked recording mediums.

According to a tenth aspect of the invention, there is provided an image forming apparatus including: a liquid droplet ejecting head that ejects liquid droplets to a recording medium to form an image; and the seasoning device according to any one of the first to ninth aspects in which the recording medium having an image formed thereon is stacked and that blows the humidified air to the stacked recording medium.

According to this configuration, since the image forming apparatus includes the seasoning device according to any one of the first to ninth aspects, it is possible to suppress the cockling (ripples) from being generated in the recording medium.

According to the aspects of the invention, it is possible to suppress the cockling (ripples) from being generated in a recording medium having an image formed thereon without depending on the material of a liquid used to form the image.

BRIEF DESCRIPTION OF THE DRAWINGS

Embodiments of the invention will be described in detail with reference to the following drawings, wherein.

DETAILED DESCRIPTION OF THE INVENTION

Figure 1:
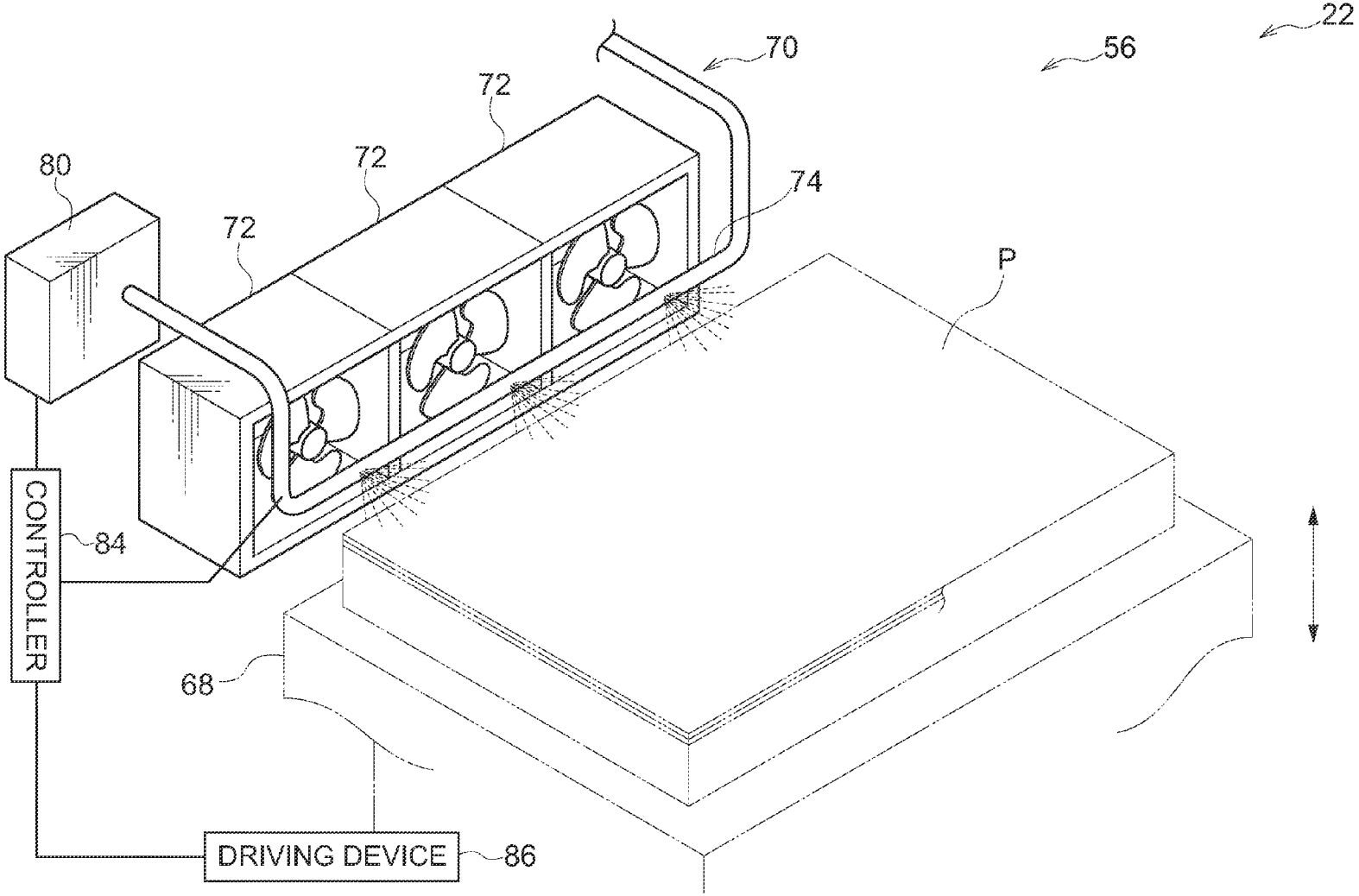
FIG. 1 is a perspective view illustrating a seasoning device according to an embodiment of the invention.

An image forming apparatus 10 according to an embodiment of the invention will be described below with reference to FIGS. 1 to 3. Arrow UP in the drawings represents an upside in a vertical direction.

Entire Configuration

Figure 3:
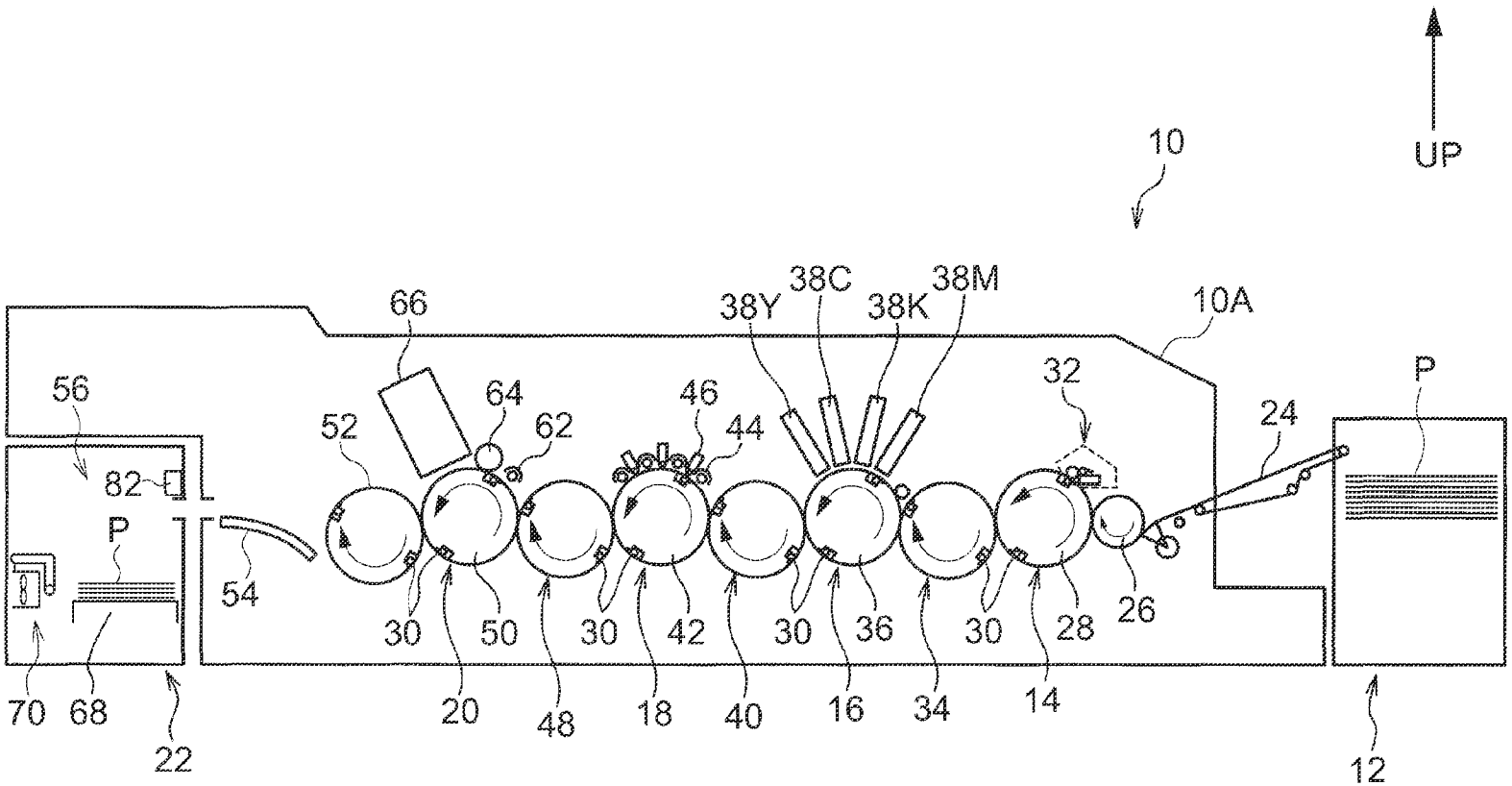
FIG. 3 is a diagram illustrating schematically illustrating the configuration of an image forming apparatus according to an embodiment of the invention.

As shown in FIG. 3, an image forming apparatus 10 includes a paper feed unit 12 that feeds a sheet of paper P as a recording medium to an apparatus main body 10A, a process liquid applying unit 14 that applies a process liquid to an image forming surface of the sheet of paper P, an image forming unit 16 that forms an image on the sheet of paper P, a drying unit 18 that reduces the moisture of (dries) the sheet of paper P so as to enhance strength of image layer of an image-formed portion in which an image is formed, a fixing unit 20 that fixes the formed image to the sheet of paper P, and a discharge unit 22 to which the sheet of paper P is discharged.

The sheets of paper P are stacked on the paper feed unit 12 and the sheets of paper P are sent out to the apparatus main body 10A by the paper feed unit 12 sheet by sheet. A feed tray 24 guiding the sheet of paper P sent out from the paper feed unit 12 to the apparatus main body 10A is disposed downstream side in the transporting direction of the sheet of paper P (hereinafter, simply referred to as "downstream side") with respect to the paper feed unit 12. A feed drum 26 rotating and transporting the sheet of paper P along the outer circumferential surface thereof is disposed in the apparatus main body 10A downstream side with respect to the feed tray 24. The sheet of paper P is transported to the process liquid applying unit 14 by the feed drum 26.

The process liquid applying unit 14 includes a process liquid applying drum 28, with rotating, receiving the sheet of paper P transported by the feed drum 26 and transporting the sheet of paper P along the outer circumferential surface thereof. Specifically, a holding member 30 holding the end of the sheet of paper P is disposed on the outer circumferential surface of the process liquid applying drum 28. According to this configuration, the sheet of paper P is transported downstream side by means of the rotation of the process liquid applying drum 28 in the state in which the end of the sheet of paper P is held by the holding member 30.

A process liquid applying device 32 applying the process liquid to the image forming surface of the sheet of paper P transported by the process liquid applying drum 28 is disposed above the process liquid applying drum 28. The process liquid has an effect of reacting with liquid droplets to be described later to aggregate a coloring material (pigment) and to promote the separation of the coloring material (pigment) from the solvent.

A transporting drum 34, with rotating, receiving the sheet of paper P transported by the process liquid applying drum 28 and transporting the sheet of paper P to the image forming unit 16 is disposed downstream side with respect to the process liquid applying drum 28.

The image forming unit 16 includes an image forming drum 36, with rotating, receiving the sheet of paper P transported by the transporting drum 34 and transporting the sheet of paper P along the outer circumferential surface thereof. A liquid droplet ejecting head 38 ejecting liquid droplets of ink or the like to the sheet of paper P transported by the image forming drum 36 to form an image on the sheet of paper P is disposed above the image forming drum 36. The liquid droplet ejecting head 38 is a so-called full-line head having an ink ejecting range corresponding to the maximum width of the sheet of paper P. In this embodiment, the liquid droplet ejecting heads 38 of four colors of Y (Yellow), M (Magenta), C (Cyan), and K (Black) as exemplary basic colors are arranged in the circumferential direction of the image forming drum 36.

A transporting drum 40 receiving the sheet of paper P transported by the image forming drum 36 and transporting the sheet of paper P to the drying unit 18 is disposed downstream side with respect to the image forming drum 36.

The drying unit 18 includes a drying drum 42, with rotating, receiving the sheet of paper P transported by the transporting drum 40 and transporting the sheet of paper P along the outer circumferential surface thereof. A halogen heater 44 and a warm air nozzle 46 as an example of a drying member are disposed above the drying drum 42. While the sheet of paper P is being transported by the drying drum 42, the moisture contained in the sheet of paper P is reduced (dried) by means of the heat from the halogen heater 44 and the warm air from the warm air nozzle 46 so as to enhance strength of image layer of the image-formed portion in which an image is formed. Accordingly, strength of image layer of the image formed on the sheet of paper P is improved.

A transporting drum 48 receiving the sheet of paper P transported by the drying drum 42 and transporting the sheet of paper P to the fixing unit 20 is disposed downstream side with respect to the drying drum 42.

The fixing unit 20 includes a fixing drum 50, with rotating, receiving the sheet of paper P transported by the transporting drum 48 and transporting the sheet of paper P along the outer circumferential surface thereof. A halogen heater 62 for heating (preliminary heating), a fixing roller 64 pressing the sheet of paper P against the fixing drum 50, and an in-line sensor 66 measuring a check pattern, an amount of moisture, a surface temperature, a gloss level, and the like of the sheet of paper P are disposed to face the outer circumferential surface of the fixing drum 50.

A discharge drum 52, with rotating, receiving the sheet of paper P transported by the fixing drum 50 and discharging the received sheet of paper P to the outside of the apparatus main body 10A is disposed downstream side with respect to the fixing drum 50.

A guide plate 54 formed in a curved shape so as to guide the sheet of paper P to the outside of the apparatus main body 10A is disposed downstream side with respect to the discharge drum 52.

The sheet of paper P discharged to the outside of the apparatus main body 10A is discharged to a seasoning device 56 disposed in the discharge unit 22 by the discharge drum 52. The details of the seasoning device 56 will be described later.

Main Configuration

The seasoning device 56 disposed at the discharge unit 22 will be described below.

In the embodiment, the seasoning device 56 is a device that adjusts moisture (humidity) of the sheets of paper P (moisture content in the sheets of paper P) by blowing humidified air at the sheets of paper P stacked in the stack unit 68.

As shown in FIG. 1, the seasoning device 56 includes a stack unit 68 in which sheets of paper P having an image formed thereon are stacked and a spray device 70 spraying humidified air to the sheets of paper P stacked in the stack unit 68.

The spray device 70 includes plural (three in this embodiment) air blowers 72 blowing air to the sheets of paper P and a temperature adjusting member (not shown in the drawing) adjusting the temperature of the air blown to the sheets of paper P by the air blowers 72.

Specifically, the plural air blowers 72 are arranged in the width direction of the sheets of paper P (the direction intersecting the discharging direction of the sheets of paper P) and blow air toward the end portion of the sheets of paper P so that the air is blown between the stacked sheets of paper P (from the end portion of the sheets of paper P).

The spray device 70 includes a water pipe 74 disposed between the air blowers 72 and the sheets of paper P, and a water supply device 80 supplying water to the water pipe 58. Plural nozzles (three in the drawings but not limited to three) spraying flowing water (in the water pipe 74) in a spray form (mist) are formed in the outer circumferential surface of the water pipe 58 and the nozzles can be opened and closed.

A humidity detecting member 82 (see FIG. 3) detecting the humidity of the portion to which the sheet of paper P is discharged from the apparatus main body 10A is provided. A controller 84 controlling the volume of water supplied to the water pipe 74 by the water supply device 80 on the basis of the detection signal from the humidity detecting member 82 is further provided. The controller 84 adjusts the driving power of the air blowers 72 depending on the discharging speed of the sheet of paper P. The controller 84 controls the selective opening and closing of the nozzles of the water pipe 74 depending on the size of the sheet of paper P so as to blow the humidified air to only the sheets of paper P. (For example, in a case of the large sheets of paper P, all of the nozzles are made to be opened, and in a case of the small sheets of paper P, for example, in accordance with the size of the sheets of paper P (in a direction intersecting the discharge direction), the nozzles positioned at both end portions in the longitudinal direction of the water pipe 74 are made to be closed.)

A driving device 86 driving the stack unit 68 so as to move up and down is disposed in the stack unit 68. The driving device 86 is actuated to move the stack unit 68 up and down under the control of the controller 84.

In this embodiment, the spray device 70 blows the air humidified in a humidity in a range from 75% RH to 85% RH (aiming at 80% RH) to the sheets of paper P so as not to increase the amount of moisture contained in the image-formed portions formed on the sheets of paper P (humidifying seasoning). In addition, after the humidified air is blown to the sheets of paper P, the controller 84 stops the spraying of water from the water pipe 74 and blows non-humidified air, that is, air in the atmosphere to the sheets of paper P (blowing seasoning).

Operation and Effect

As shown in FIG. 6, the sheet of paper P fed from the paper feed unit 12 is transported along the outer circumferential surfaces of the rotating feed drum 26 and the rotating process liquid applying drum 28. In the process liquid applying unit 14, the process liquid applying device 32 applies a process liquid to the image forming surface of the sheet of paper P transported along the outer circumferential surface of the process liquid applying drum 28.

The sheet of paper P to which the process liquid has been applied is sent to the transporting drum 34 and is transported along the outer circumferential surfaces of the rotating transporting drum 34 and the rotating image forming drum 36. In the image forming unit 16, the liquid droplet ejecting heads 38 of the respective colors eject the liquid droplets of ink or the like to the image forming surface of the sheet of paper P transported by the image forming drum 36 to form an image on the sheet of paper P.

The sheet of paper P having an image formed on the image forming surface thereof is sent to the transporting drum 40 and is transported along the outer circumferential surfaces of the rotating transporting drum 40 and the rotating drying drum 42. In the drying unit 18, the sheet of paper P transported by the drying drum 42 is dried by means of the heat from the halogen heater 44 and the warm air blown from the warm air nozzle 46. That is, the moisture contained in the sheet of paper P is reduced (dried), thereby enhancing strength of image layer of the image-formed portion in which the image has been formed.

The sheet of paper P which is made to be to a high temperature by means of the heat from the halogen heater 44 and the warm air blown from the warm air nozzle 46 is sent to the transporting drum 48 and is transported along the outer circumferential surfaces of the rotating transporting drum 48 and the rotating fixing drum 50. In the fixing unit 20, the halogen heater 62 disposed to face the fixing drum 50 fixes the image formed on the sheet of paper P onto the sheet of paper P by means of heat. The sheet of paper P transported by the fixing drum 50 is pressed against the fixing drum 50 by the fixing roller 64 and passes through the portion facing the in-line sensor 66. The in-line sensor 66 measures a check pattern, an amount of moisture, a surface temperature, a gloss level, and the like of the sheet of paper P passing therethrough.

The sheet of paper P having been subjected to the measurement by the in-line sensor 66 is sent to the discharge drum 52, is transported along the outer circumferential surface of the rotating discharge drum 52, is guided by the guide plate 54, and is discharged to the discharge unit 22 outside the apparatus main body 10A.

When the sheet of paper P discharged from the apparatus main body 10A is left in the stacked state, it is thought the cockling (ripples) are generated due to (depending on) the difference in the amount of moisture between an image-formed portion containing the moisture of the liquid droplets and a non-image-formed portion not containing the moisture of the liquid droplets.

Figure 2A:
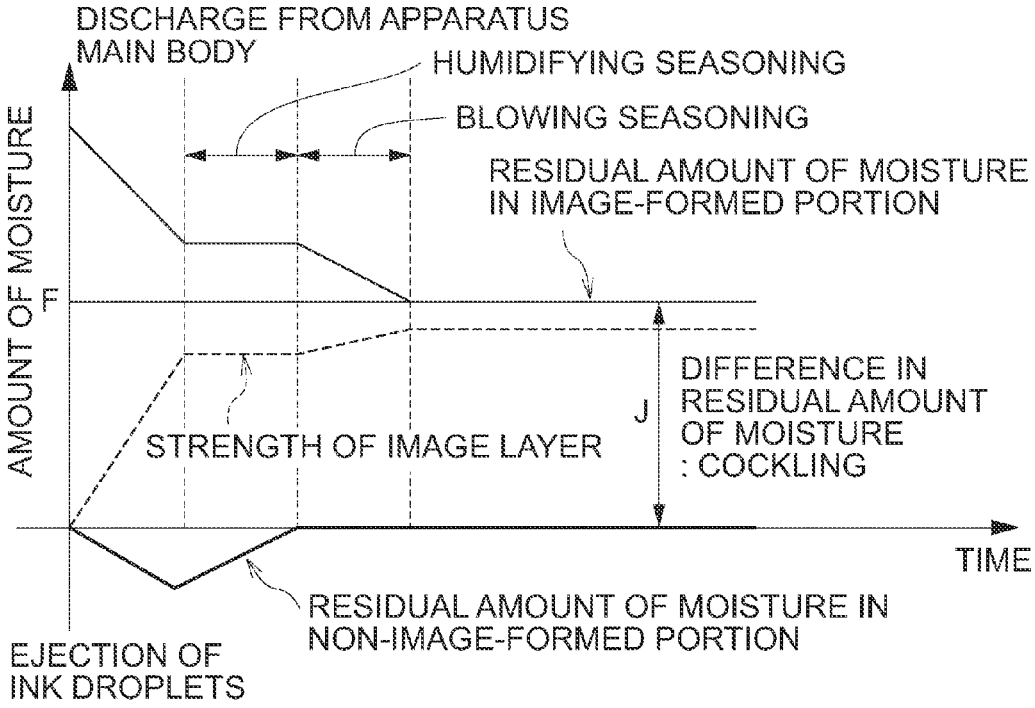
FIGS. 2A and 2B are diagrams illustrating an amount of moisture in a sheet of paper when the seasoning device according to the embodiment of the invention is used and an amount of moisture in a sheet of paper according to the related art.
Figure 2B:
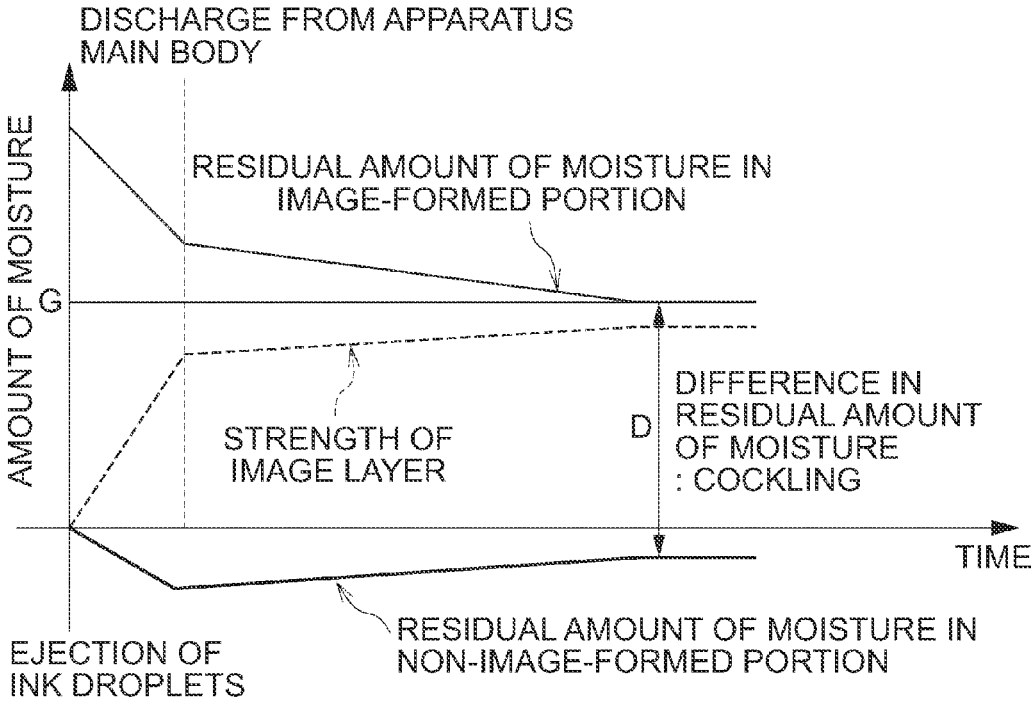

FIG. 2B shows a graph in a case in which a sheet of paper P discharged from the apparatus main body 10A is left in the stacked state. The vertical axis of the graph represents the amount of moisture and the origin of the vertical axis is set to the amount of moisture originally contained in the sheet of paper P. On the other hand, the horizontal axis represents the time and the origin of the horizontal axis is set to the time at which the sheet of paper P passes through the drying unit 18.

As can be seen from the graph, because of the ejection of the liquid droplets, the amount of moisture in the image-formed portion in which an image is formed on the sheet of paper P is larger than the amount of moisture in the non-image-formed portion in which an image is not formed in the sheet of paper P.

In the apparatus main body 10A, the amounts of moisture in the image-formed portion and the non-image-formed portion are reduced by means of the heat from the halogen heater 44 and the warm air from the warm air nozzle 46, which are disposed in the drying unit 18, thereby enhancing strength of image layer of the image-formed portion. Here, the strength of image layer is represented by the vertical axis.

When the sheet of paper P is discharged from the apparatus main body 10A and then is left in the stacked state, the amount of moisture in the image-formed portion is reduced and the amount of moisture in the non-image-formed portion is increased with the lapse of time. Accordingly, the difference in the amounts of moisture between the image-formed portion and the non-image-formed portion (D in FIG. 2B) is reduced. However, the amount of moisture in the non-image-formed portion is not returned to the amount of moisture originally contained in the sheet of paper P if the sheet of paper P is merely left undone (uncontrolled) in this way.

Since the amount of moisture in the non-image-formed portion is not returned to the amount of moisture originally contained in the sheet of paper P, it is thought that the difference in the amount of moisture between the image-formed portion and the non-image-formed portion is great and thus the cockling (ripples) is generated in the sheet of paper P.

As shown in FIG. 1, in this embodiment, the sheet of paper P discharged from the apparatus main body 10A is stacked in the stack unit 68 provided in the seasoning device 56 and humidified air (humidified in 80% RH in this embodiment) is blown thereto by the spray device 70 (humidifying seasoning).

The humidified air blown (emitted) from the spray device 70 is blown between the sheets of paper P and supplies moisture to the non-image-formed portions. After blowing the humidified air for 5 minutes, the nozzles of the water pipe 74 are closed and air of the atmosphere, which is not humidified, is blown to the sheets of paper P for 10 minutes under the control of the controller 84 (blowing seasoning).

FIG. 2A shows a graph illustrating the relationship between the amount of moisture and the time in a case where the humidifying seasoning is performed on a sheet of paper P discharged from the apparatus main body 10A for 5 minutes and the blowing seasoning is performed for 10 minutes after the humidifying seasoning is performed as in this example.

As can be seen from this graph, the amount of moisture in the image-formed portion of the sheet of paper P is larger than the amount of moisture in the non-image-formed portion. In the apparatus main body 10A, the amounts of moisture in the image-formed portion and the non-image-formed portion are reduced by means of the heat from the halogen heater 44 and the warm air from the warm air nozzle 46, thereby enhancing strength of image layer of the image-formed portion.

When a sheet of paper P is discharged from the apparatus main body 10A and the humidifying seasoning is performed for 5 minutes, the amount of moisture in the non-image-formed portion is returned to the amount of moisture originally contained in the sheet of paper P. The amount of moisture in the image-formed portion is not reduced but is maintained in a constant state.

After performing of the 5 minutes of humidifying seasoning is finished, the blowing seasoning is performed for 10 minutes. By this, the image-formed portion is adapted to the atmosphere and the amount of moisture in the image-formed portion is thus reduced. Specifically, by performing the blowing seasoning, the amount of moisture (F shown in FIG. 2A) in the image-formed portion becomes substantially equal to the amount of moisture (G shown in FIG. 2B) in the image-formed portion in a case where the sheet of paper P discharged from the apparatus main body 10A is left undone.

Accordingly, the difference in the amounts of moisture (J shown in FIG. 2A) between the image-formed portion and the non-image-formed portion decreases. Since the amount of moisture in the non-image-formed portion is returned to the amount of moisture originally contained in the sheet of paper P unlike the case in which the sheet of paper P is left undone, the difference in the amounts of moisture (J shown in FIG. 2A) between the image-formed portion and the non-image-formed portion is smaller than the difference in the amounts of moisture (D shown in FIG. 2B) between the image-formed portion and the non-image-formed portion in the case in which the sheet of paper P is merely left undone.

In this way, by performing the humidifying seasoning, it is possible to reduce the difference in the amounts of moisture between the image-formed portion and the non-image-formed portion.

Since the difference in the amounts of moisture between the image-formed portion and the non-image-formed portion is reduced, it is possible to suppress the cockling (ripples) from being generated in the sheet of paper P.

By performing the blowing seasoning, it is possible to effectively adapt the image-formed portion to the ambience and reduce the amount of moisture in the image-formed portion.

By setting the air blown to the sheets of paper P to a humidity of 75% RH to 85% RH (aiming at 80% RH) at the time of performing the humidifying seasoning, it is possible to suppress the amount of moisture contained in the image-formed portion from increasing.

By suppressing the amount of moisture contained in the image-formed portion from increasing, it is possible to suppress the difference in the amounts of moisture between the image-formed portion and the non-image-formed portion from increasing.

The spray device 70 extends in the direction intersecting the discharging direction of the sheet of paper P. Accordingly, it is possible to uniformly blow the humidified air all over the width direction of the sheet of paper P.

Although a specific embodiment of the invention has been described in detail, it will be apparent to those skilled in the art that the invention is not particularly limited to the embodiment but may be modified in various forms within the scope of the invention. For example, it has been described in the embodiment that the air with a humidity of 75% RH to 85% RH (aiming at 80% RH) is blown to the sheet of paper P at the time of performing the humidifying seasoning. However, the invention is not limited to this configuration, but the humidity may be set to such a humidity to promote the increase in the amount of moisture in the non-image-formed portion and to suppress the increase in the amount of moisture in the image-formed portion.

Although not specifically described in the embodiment, a sheet bundle of the sheets of paper P stacked in the stack unit 68 may be moved to a particular different place after the humidifying seasoning and the blowing seasoning are ended. In this case, it is possible to efficiently perform the humidifying seasoning and the blowing seasoning to the sheets of paper P stacked in the stack unit 68 after the moving.

Although not specifically described in the embodiment, the driving device 86 may be actuated to move up and down the stack unit 68 under the control of the controller 84 at the time of performing the humidifying seasoning or the blowing seasoning. In this way, by moving up and down the stack unit 68, the sheets of paper P are moved up and down with respect to the spray device 70, thereby effectively blowing the humidified air between the sheets of paper P.

Although not specifically described in the embodiment, the controller 84 may adjust the volume of water supplied to the water pipe 74 by the water supply device 80 on the basis of the detection signal from the humidity detecting member 82. In this case, it is possible to adjust the humidity of the humidified air corresponding to (on the basis of) the humidity of the portion in which the sheets of paper P are discharged, with a simple structure.

Although not specifically described in the embodiment, the controller 84 may adjust the driving power of the air blowers 72 corresponding to (on the basis of) the discharging speed of the sheets of paper P. In this case, it is possible to set the volume of air blown to the sheets of paper P to the optimal volume corresponding to the discharging speed of the sheets of paper P.

In a case where the controller 84 is selectively open and close the nozzles of the water pipe 74 depending on the size of the sheet of paper P, it is possible to blow the humidified air to only the sheets of paper P and thus to suppress the humidified air from flying around the sheets of paper P.

What is claimed is:

1. A seasoning device comprising:

a stack unit on which a recording medium is stacked, the recording medium having an image formed thereon by ejection of liquid droplets and the image being dried; and a spray unit that blows humidified air at plural recording mediums that are in a stacked state in the stack unit, wherein the spray unit blows non-humidified air from the atmosphere at the plural recording mediums that are in the stacked state in the stack unit, after blowing the humidified air at the plural recording mediums that are in the stacked state in the stack unit.

2. The seasoning device of claim 1, wherein the spray unit blows humidified air having a humidity which does not raise a residual amount of moisture contained in an image-formed portion of the recording medium to which the liquid droplets have been ejected to form the image.

3. The seasoning device of claim 1, wherein:

the recording medium, on which the image is formed, is discharged from an apparatus main body of an image forming apparatus that forms the image, and the discharged recording medium is stacked in the stack unit, and the spray unit extends in a direction intersecting a discharge direction of the discharged recording medium.

4. The seasoning device of claim 3, wherein the spray unit includes:

a water pipe having nozzles from which a mist is sprayed, a water supply device that supplies water to the water pipe, and an air blower that blows humidified air that is humidified by the mist sprayed from the nozzles of the water pipe.

5. The seasoning device of claim 4, further comprising:

a humidity detecting section that detects the humidity of a region at which the discharged recording medium is discharged from the apparatus main body; and a controller that controls a volume of water supplied to the water pipe by the water supply device on the basis of a detection signal from the humidity detecting section.

6. The seasoning device of claim 5, wherein the controller controls a driving power of the air blower according to a discharge speed of the discharged recording medium.

7. The seasoning device of claim 5, wherein the controller selectively controls opening and closing of the nozzles of the water pipe according to a size of the discharged recording medium.

8. The seasoning device of claim 1, wherein the stack unit is vertically movable.

9. An image forming apparatus comprising:

a liquid droplet ejecting head that ejects liquid droplets to a recording medium to form an image; and a seasoning device including:

a stack unit on which a recording medium is stacked, the recording medium having an image formed thereon by ejection of liquid droplets and the image being dried; and a spray unit that blows humidified air plural recording mediums that are in a stacked state in the stack unit, wherein the spray unit blows non-humidified air in the atmosphere at the plural recording mediums that are in the stacked state in the stack unit, after blowing the humidified air at the plural recording mediums that are in the stacked state in the stack unit.

10. The image forming apparatus of claim 9, wherein the spray unit blows humidified air having a humidity which does not raise a residual amount of moisture contained in an image-formed portion of the recording medium to which the liquid droplets have been ejected to form the image.

11. The image forming apparatus of claim 9, wherein:

the recording medium, on which the image is formed, is discharged from an apparatus main body of an image forming apparatus that forms the image, and the discharged recording medium is stacked in the stack unit, and the spray unit extends in a direction intersecting a discharge direction of the discharged recording medium.

12. The image forming apparatus of claim 11, wherein the spray unit includes:

a water pipe having nozzles from which a mist is sprayed, a water supply device that supplies water to the water pipe, and an air blower that blows humidified air that is humidified by the mist sprayed from the nozzles of the water pipe.

13. The image forming apparatus of claim 12, further comprising:

a humidity detecting section that detects the humidity of a region at which the discharged recording medium is discharged from the apparatus main body; and a controller that controls a volume of water supplied to the water pipe by the water supply device on the basis of a detection signal from the humidity detecting section.

14. The image forming apparatus of claim 13, wherein the controller controls a driving power of the air blower according to a discharge speed of the discharged recording medium.

15. The image forming apparatus of claim 13, wherein the controller selectively controls opening and closing of the nozzles of the water pipe according to a size of the discharged recording medium.

16. The image forming apparatus of claim 9, wherein the stack unit is vertically movable.

* * * * *